US006343560B1

(12) United States Patent
Myers

(10) Patent No.: US 6,343,560 B1
(45) Date of Patent: Feb. 5, 2002

(54) PONTOON WATERCRAFT

(76) Inventor: Robert J. Myers, 7510 Shoreline Dr., A-10, Stockton, CA (US) 95219

( * ) Notice: Subject to any disclaimer, the term of this patent is extended or adjusted under 35 U.S.C. 154(b) by 0 days.

(21) Appl. No.: 09/660,997

(22) Filed: Sep. 13, 2000

(51) Int. Cl.[7] ..... B63B 1/00

(52) U.S. Cl. ..... 114/61.25; 114/354

(58) Field of Search ..... 114/343, 364, 114/345, 352–354, 61.1, 61.24, 61.25

(56) References Cited

U.S. PATENT DOCUMENTS 3,473,502 A * 10/1969 Wittkamp ..... 114/345
4,766,830 A * 8/1988 Kunz ..... 114/61
4,813,366 A * 3/1989 Elder ..... 114/61
5,878,688 A * 3/1999 Merrett et al. ..... 114/354

FOREIGN PATENT DOCUMENTS

DE 3304702 * 8/1984 ..... 114/61.25

* cited by examiner

*Primary Examiner*—Ed Swinehart
(74) *Attorney, Agent, or Firm*—Milburn & Peterson, P.C.; Robert C. Peterson

(57) ABSTRACT

A personal pontoon watercraft having a pair of pontoons with twin bladders secured by a three piece yoke frame which maintain the pontoons spaced apart and symmetrical and parallel with each other to accommodate the user, with an integrated load leveling system for personal and operational convenience. The watercraft is adapted to support an adjustable motor and anchor mount behind the user and two piece oars in gunwales at the outermost part of the yoke frame. The design provides for auxiliary items such as a mesh fish basket, storage containers and the like. Further, the watercraft is assembled with no special tools and when disassembled the entire watercraft can be stored in a suitable bag having a length of approximately four feet and a girth of approximately six to seven feet.

20 Claims, 7 Drawing Sheets

PONTOON WATERCRAFT

BACKGROUND OF THE INVENTION

1. Field

This invention relates to an individual watercraft. More specifically, the invention is directed to inflatable pontoon watercraft, and provides several enhancements for such boats.

2. State of the Art

Typically, boats or watercrafts designed for individuals are powered by the action of swim fins on the user's feet or of oars supported on the framework of the watercraft. Small motors may also be used on these boats. Such boats are popularly used as fishing platforms, but they are also used more generally for water transport, such as in connection with hunting, touring or white water rafting.

These watercraft generally comprise two inflatable cylindrical pontoons harnessed together by means of a rigid mainframe. The mainframe functions as the support for seating or decking, and also serves as the attachment point for any optional equipment; such as foot rests, frame extensions, motors, oars, rod holders, beverage holders, fish finders, stripping aprons, cargo containers, anchors, etc.

Mainframes have typically been constructed of aluminum. In general practice, assembly of the mainframe to the pontoons requires that the mainframe rest directly on the pontoon surfaces. Significant problems have been associated with such direct contact between the mainframe and pontoons. Friction between the surfaces of a pontoon and a frame during use of the boat causes black oxide to rub off of the mainframe and stain the pontoons and anything else coming in contact with the oxide. Aluminum mainframes also are easily scratched and dented during use, transportation and storage. Pontoon surfaces are subject to puncture and abrasion, because of the conventional materials of construction of the pontoons, typically PVC, rubber, rubberized fabric or similar polymeric materials. Raised or rough areas on the mainframe cause cuts and abraded areas in the pontoon surfaces. To avoid staining, puncture and abrasion problems, boat owners require considerable time in maintaining the boat. The aluminum frame must be kept painted to avoid any direct surface contact between the mainframe and the pontoons; and any dents or nicks must be smoothed out before the mainframe can be attached to the pontoons.

Historically, these boats have been designed with wrap around mainframes supported on a pair of inflatable pontoons. The mainframe harnesses the pontoons in spaced tandem arrangement. The major portion of the frame is thus suspended between the pontoons as a support structure having tide members, front and rear cross members and a central platform. Any additional boat components and accessories are attached to this support structure. Misalignment of the pontoons and mainframe create undesired operational problems in controlling the boat.

The bending moments generated in conventional mainframes have been observed to have a negative impact on the durability of the frame. The largest bending moments generated in the mainframe occur where the side members are joined to the central platform. Breakage often occurs in this area, especially under conditions causing the pontoons to bounce or the load to fluctuate (in rough water, for example). Overstress failures have also been observed to occur in the regions where foot rest and cargo bay accessories are attached to a frame.

Accessories are typically attached to side members of a mainframe, to be convenient to a boater's hand during boating. Unfortunately, any strap used to attach an accessory to a side member of the mainframe is inherently pushed into the pontoon surfaces when a mainframe is mounted on the pontoons. Other fastener systems and accessory surfaces moving against the pontoons also cause problems associated with wear. Vibration due to wind or rough water, or the transport of an assembled boat, causes abrasion of the pontoon surfaces under these pressure points.

Another commonly used method used to attach accessories to the mainframe side members is to fasten or integrally form a clevis at one end of the accessory. The clevis slips over a side member and is fixed in place. Oar locks, fishing rod holders, and beverage holders are examples of accessories that may be attached to a mainframe in this manner. Conventionally, clevis and side members have been made of aluminum. Galling between the clevis and side member surfaces has been found to present a significant problem after short usage times.

Wrap around mainframes are intended to provide stability along the full length of each pontoon and maintain the pontoon pair in parallel position even in relatively rough water conditions. Unfortunately, some conventional wrap around design obstructs a user's entry and exit from the vessel. This problem increases with increasing water depth. Historically, the front cross member of a mainframe has acted as a footrest. A footrest provides many practical advantages; for example, for generally relaxing, for resting and stretching muscles, or for supporting a user's feet in an elevated position to clear bottom hazards. It also may serve as a foot brace for more efficient rowing action.

A framing system which eliminates front cross members offers convenient walk-in access to the vessel's seating area, but with the accompanying loss of the footrest. "L"-shaped foot rest extensions have thus been attached to the side members of certain mainframes lacking a front cross member. Neither the conventional front cross member nor the newer foot rest extension is continuously adjustable to comfortably accommodate various leg lengths.

It is recognized that it would be beneficial to provide adequate leg support above the surface of a kick boat's foot rest. Such leg support would be expected to alleviate leg strain when the feet are elevated. Hypothetically, a cross member could provide additional leg support with the use of a foot rest attachment suspended from and located forward of the member, but only if the user's legs, through serendipity, happened to be of the correct length to take advantage of such a feature.

Many pontoon boat accessories are available to enhance user comfort and convenience. Historically, it has been difficult to attach accessories to the mainframe in a manner avoiding entanglement of the boater or abrasion of the pontoons, and to avoid clutter, while allowing the accessory to be easily accessed when wanted. Historically, accessories are provided to serve a single function. It would be of benefit to provide adaptable accessories that can meet a variety of needs, to eliminate clutter.

Conventional boat models are provided with the aim of meeting the needs of boaters primarily interested in one particular type of application. Boats configured for lake fishing are not necessarily convenient for river fishing or river running for example. A versatile boat that can be configured to meet a variety of needs would be highly advantageous.

Storage of inflatable pontoon boats has been inconvenient for those, such as apartment dwellers, having limited storage space. These boats have generally been bulky, even when disassembled for storage or transport. Duffle bags and bags with attached back pack straps have been used to increase boat portability.

Swept pontoons are being offered to replace the previously favored cylindrical pontoons in some applications. When viewed in a longitudinal cross section, cylindrical pontoons have parallel walls over the water contact area, that rest flat on the water. Swept pontoons may include a cylindrical midsection, but are otherwise characterized by converging walls that curve up away from the plane of the water surface. Fully swept pontoons have no cylindrical sections and are offered with varying radii of curvature.

Swept pontoons greatly decrease the water resistance of the boats and allow for greater maneuverability and easy propulsion action. However, boats utilizing swept pontoons are less stable in the water and so are less forgiving of longitudinal load imbalances. Therefore, there is an increased need for adjustability in situating the mainframe longitudinally along the pontoons, to balance the load carried by the pontoons. Further, there is an increase necessity in maintaining the frame attached to the pontoons at a precise and repetitive location for each assembly of the craft.

There remains a need for a versatile boat with adjustable and secure foot, leg and seat support structures, improved storage, and reduced maintenance requirements. There further remains a need for a boat assembly capable of more efficient storage and transport, and for a safe, durable, and collapsible design that provides rigid stability when reassembled. There is also a need for improved load balancing capabilities for swept pontoon boats. Elimination of the need for tools and loose hardware for assembly and disassembly would eliminate a major source of inconvenience, and would help reduce weight, thereby enhancing portability. Improved accessory storage and an adjustable and safe stripping apron are also needed.

SUMMARY OF THE INVENTION

The present invention is an improved pontoon watercraft, which includes inflatable high-rise pontoons and a yoke assembly for spacing the pontoons in a parallel orientation with a central support for mounting a seat, cargo rack, motor support and anchor mounting and a pair of foot rests. The yoke assembly may be assembled and disassembled without any special tools. The yoke assembly has gunwales for supporting oar locks and oars. The high-rise pontoons provide appropriate contact with the water.

The present invention provides a personal pontoon watercraft that may be assembled and disassembled with no special tools and minimum of equipment for inflating the pontoons. When disassembled the watercraft may be stored in a relatively small canvass or other suitable bag having a length of four (4) feet and a girth of six to seven (6–7) feet. The watercraft comprises two inflatable pontoons which may be twin bladder pontoons to provide extra puncture protection; a yoke frame having two yoke members contoured to and spanning the top surface of the pontoons, which are spaced-apart by a central support; each yoke member is retained secured to the central support by struts projecting from the yoke member with snap button locks that seat in apertures in cross bars of the central support; the yoke frame and central support accommodates an integrated load distribution system, as well as, oar locks, oars, trolling motor and anchor mount.

Further, the present invention provides a personal pontoon watercraft which includes twin bladders in each pontoon for inflating the pontoons and minimize catastrophic puncture of both pontoons. The pontoons are held by a yoke frame in which the yoke members span the top side of the pontoons and are contoured thereto. This maintains the pontoons upright when properly secured. The yoke frame includes D-ring tie downs for securing the pontoon straps which span and are secured to the underside of the pontoons, and in conjunction with the D-ring tie downs maintain the pontoons parallel and symmetrical with respect to each other in order to maintain balance and stability of the personal pontoon watercraft.

In order to accomplish this symmetry, the straps, generally of nylon webbing, are sewn or otherwise affixed to each of the pontoons precisely the same. First, a long strap is sewn or otherwise secured along the underside of each pontoon oriented in a circular plane through the pontoon such that the longitudinal axis of the pontoon is perpendicular to the circular plane. Next, with the same orientation as the long strap, a shorter strap with a buckle attached to each end, is sewn or otherwise affixed over the long strap along the underside. The long strap has its ends loose or free and are of sufficient length to extend from the underside of each pontoon through the D-ring tie downs back down and thread through the buckles, attached to the end of each of the shorter straps. Additionally, a strip of same material as the pontoons is over sewn or secured covering the web straps along the underside to protect them from underwater and shore line damage. Each pontoon has two sets of these straps appropriately spaced for attachment to the D-ring tie downs on the yoke frame. The positioning of the straps with the longitudinal axis of the pontoons perpendicular to the circular plane of the straps assures that with repeated assembly and disassembly of the pontoon watercraft, the pontoons will always be properly aligned when attached to the yoke frame. The yoke frame with the D-ring tie downs will always maintain the pontoons of the watercraft symmetrical and parallel.

Further, the present invention provides the personal pontoon watercraft with an integrated load distribution system whereby the individual to distribute the load can adjust leg rests to multiple positions, adjust the seat forward or backward in several positions, adjust oar locks provided gunwales to several forward or rearward positions, and adjust the motor and anchor mount to several forward or rearward positions, for the purpose of individual comfort and maintaining the watercraft load distribution in the water such that the center of gravity will prevent the watercraft from constantly turning around to seek the direction of water flow with the end sitting deeper in the water, turning down stream. Likewise, the center of gravity may be adjusted to maintain the bow deeper in the water to follow the stream flow.

The two piece oars are designed to snap together with two snap button looks oriented with the buttons in separate circular planes and angularly displaced from each other by ninety (90°) degrees which prevents inadvertent separation of the two sections by the user or from the oar snagging on an underwater or narrow watercourse obstruction.

Other features include a reinforced tubular motor and anchor mount at a convenient height above the water line, a slide out mesh fish basket, a wire mesh storage compartment, Velcro fastener retained nylon side storage boxes, and the like.

DETAILED DESCRIPTION OF THE PREFERRED EMBODIMENT

Figure 1:
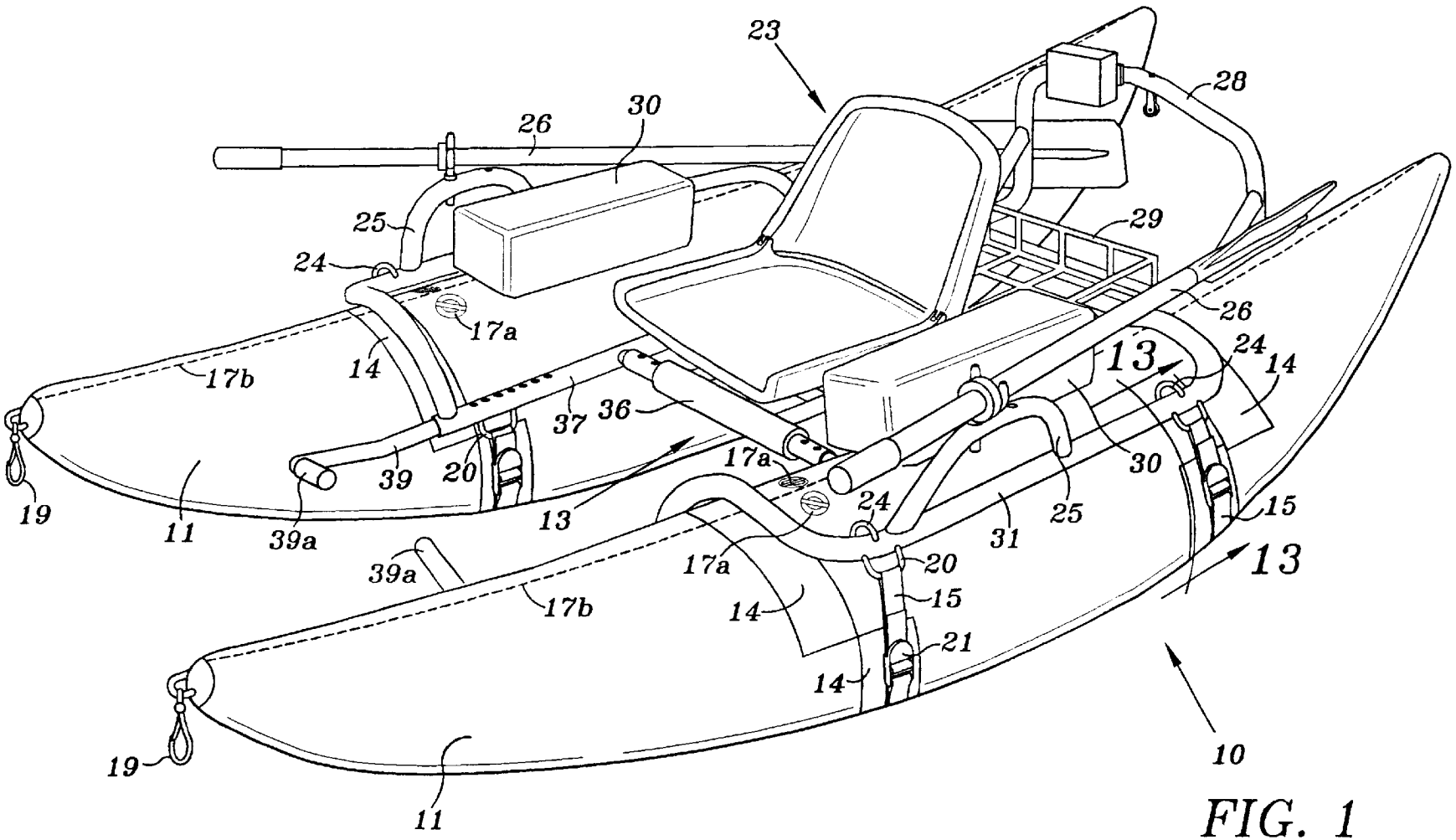
FIG. 1 is a pictorial view of the pontoon watercraft fully assembled and ready for launching.
Figure 14:
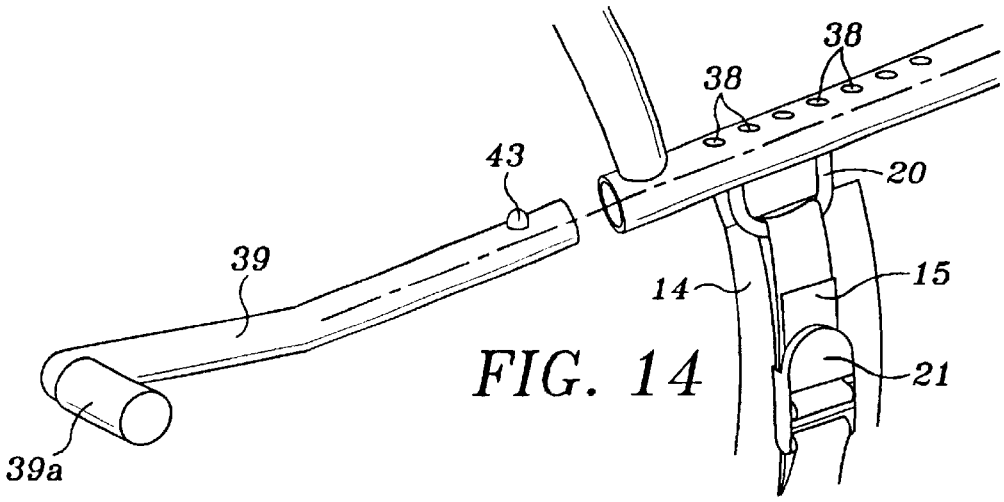
FIG. 14 illustrates the buckle and strap arrangement for securing the yoke frame to the pontoons.
Figure 2:
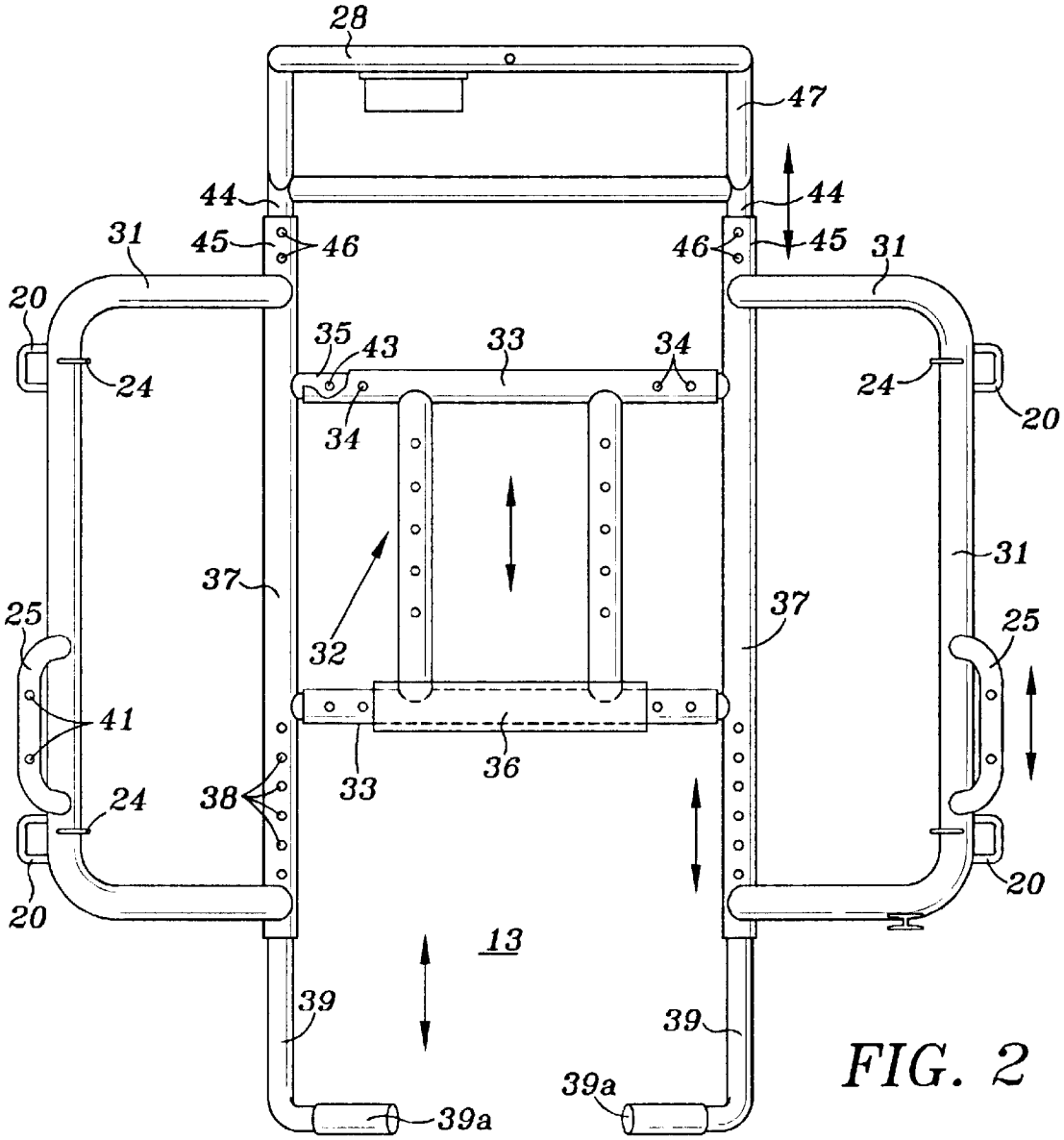
FIG. 2 is a top view of the yoke frame assembled with foot rests and motor mount in place.
Figure 3:
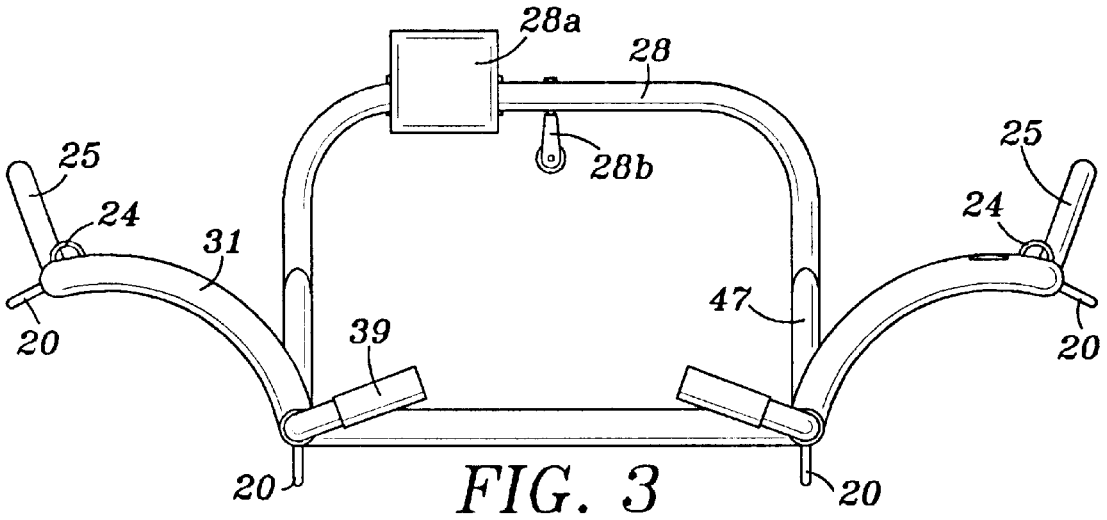
FIG. 3 is a front view yoke frame with motor mount.
Figure 4:
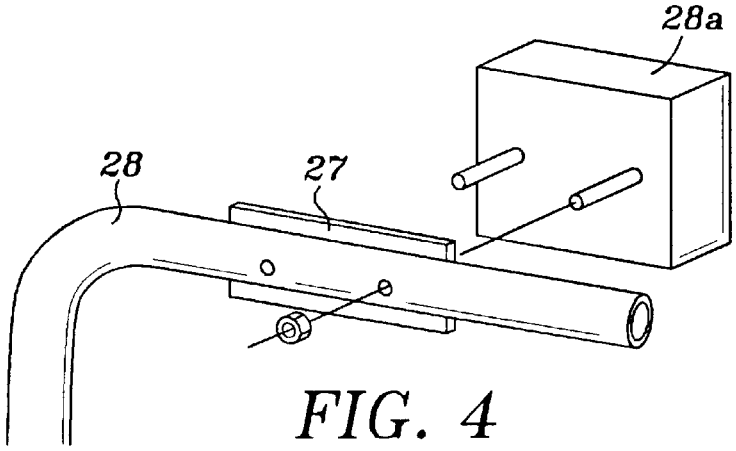
FIG. 4 is an exploded fragmented view of the motor support and anchor mount illustrating the mounting.
Figure 5:
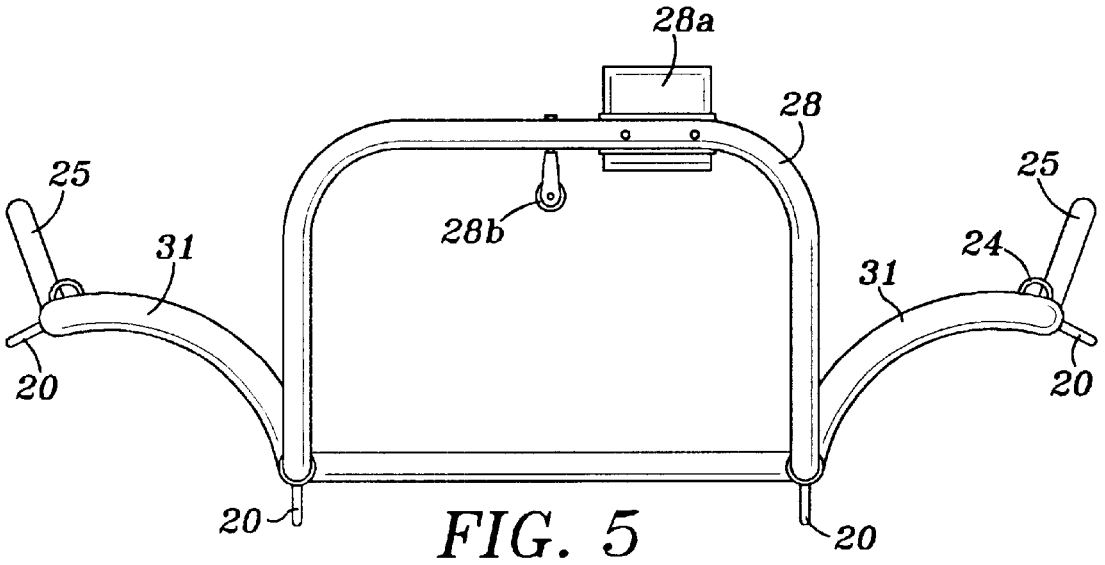
FIG. 5 is a back view of the yoke frame with motor mount.
Figure 6:
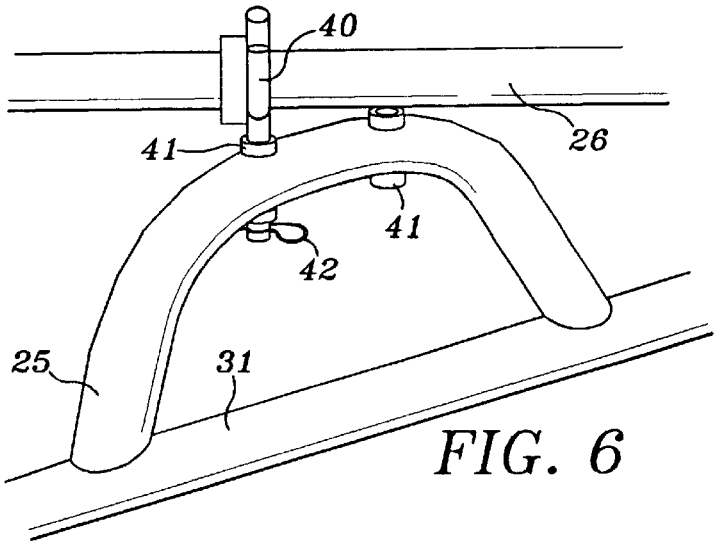
FIG. 6 illustrates the gunwales with oar lock and oar mounting.
Figure 7:
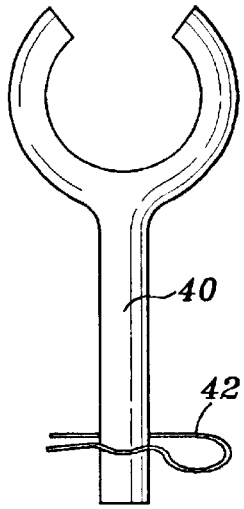
FIG. 7 illustrates the oar lock and security clip.
Figure 8:
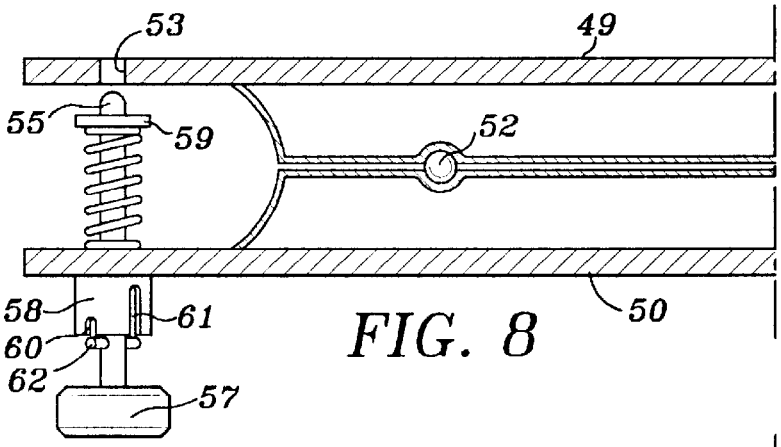
FIG. 8 illustrates a partial sectional view of the seat mount illustrated in FIGS. 18 and 19 with the seat latching mechanism unlocked.

Referring now to FIGS. 1 through 19, and in particular FIGS. 1 through 12, a pontoon watercraft 10 is illustrated. The watercraft 10 has a pair of inflatable pontoons 11, having a yoke frame generally 13. Yoke frame 13 is seated on pontoons 11 on reinforcing strips 14 and held in place by straps 15 with buckles 21 as more fully described later. Folding seat 23 is mounted on yoke frame 13. Gunwales 25, which are part of yoke frame 13 mount two piece oars 26. Motor and anchor mount 28 is attached to the rear of yoke frame 13. Cargo basket 29 is positioned over the rear portion of yoke frame 13. Storage compartments 30 are detachably mounted to pontoons 11 by Velcro fastener or the like.

Referring now to FIGS. 2 through 5, yoke frame 13 includes yoke members 31, one on the port side and one on the starboard side of watercraft 10. Each yoke member 31 is contoured to seat on reinforcing strips 14 of each pontoon 11. Yoke members 31 are spaced apart by seat mount 32. Inmost rails 37 of yoke members 31 include struts or side butts 35 with snap button locks 43 which seat in cross members 33 of seat mount 32 with snap button locks 43 seated in apertures 34. Yoke members S1 support D-rings 20 and gunwales 25. Inmost rails 37 of yoke mount 31 have six apertures 38 that accommodate snap button locks 43 on foot rest 39 which are inserted in inmost rails 37 and provide six positions for adjusting the foot rest 39. Likewise, gunwales 25 oar lock mounting inserts 41 which provide two positions for mounting the oar locks 40. If desired the oar lock mounting inserts 41 could be provided with more than two positions by increasing the length of gunwales 25, see FIG. 6. The oar locks 40 are held in oar lock mounting inserts 41 by oar lock clips 42. Motor and anchor mount 28 have feet 44 that adjustably seat in rear projections 45 of inmost rails 37 and have apertures 46 to receive snap button locks 43 mounted on feet 44. For extra stability motor and anchor mount 28 has struts 47. Motor and anchor mount 28 has a motor mount 28*a* and an anchor mount 28*b*.

Referring now, in particular, to FIGS. 8, 9, 18 and 19, the swivel arrangement for folding seat 23 is best illustrated. Seat swivel 48 consists of upper plate 49 and lower plate 50 which is secured on central pivot 51 with ball bearings 52. Upper plate 49 has an aperture 53 which seats locking pin 55 when the swivel seat is in the locked position. The seat swivel 48 locking arrangement includes locking pin 55, spring 56 with spring retainer 59, knob 57, sleeve 58 with a short slot 60 and deep slot 61. Locking pin 55 has lugs 62 adapted to seat in short slot 60 or deep slot 61 to allow seat 23 to swivel or to lock seat 23 in place. Seat swivel 48 is attached to seat mount 32 in aperture 63 of seat mount 32. Suitable fasteners such as bolts 54 with wing nuts 65 may be used to attach seat swivel 48 to seat mounts 32. Seat 23 is secured to upper plate 49 by suitable fasteners. Seat back 23*a* and seat bottom 23*b* are hinged by sex bolt 64 secured on each side of seat bottom 23*b* and seat back 23*a*.

Figure 12:
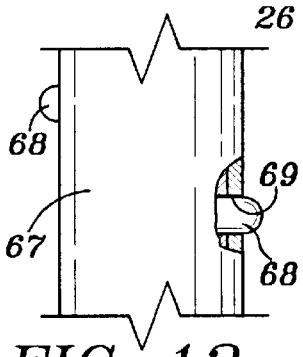
FIG. 12 is a partial top view of the oar in FIG. 10 illustrating the displacement of the snap locks.
Figure 9:
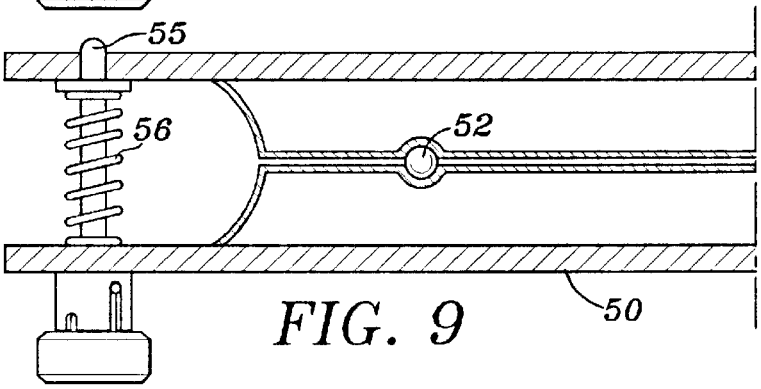
FIG. 9 illustrates a partial sectional view of the seat mount illustrated in FIGS. 18 and 19 with the seat latching mechanism locked.
Figure 11:
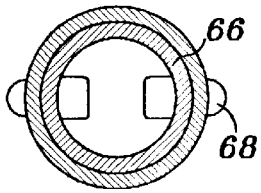
FIG. 11 is a cross section taken along lines of 11—11 in FIG. 10 illustrating the snap button locks for maintaining the two pieces of the oar connected.
Figure 10:
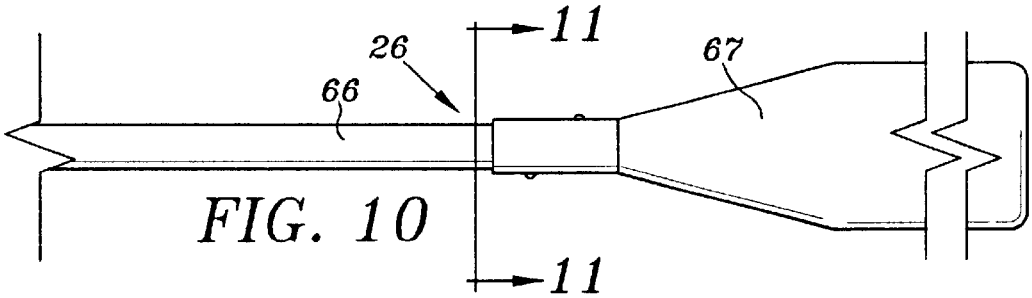
FIG. 10 illustrates the two piece oar.

The two piece oars are best illustrated in FIGS. 10, 11 and 12. Each oar 26 has shank end 66 and blade member 67. Shank member 66 has snap button locks 68 which seat in aperture 69. Snap button locks 68 are in different planes and spaced apart to maintain oars 26 connected without inadvertent separation by accidentally pushing one of the snap button locks 68 or the oar 26 being snagged on something in the water.

Figure 15:
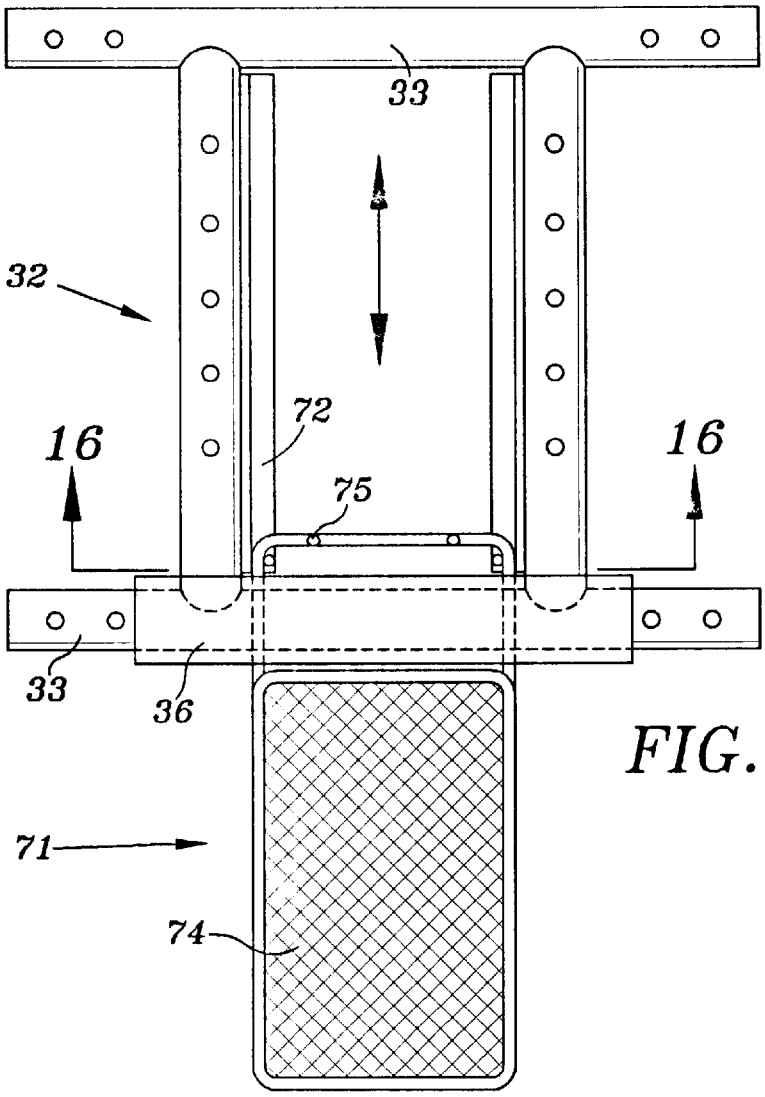
FIG. 15 illustrates a fish basket which is extended from under the seat illustrated in FIG. 18.
Figure 16:
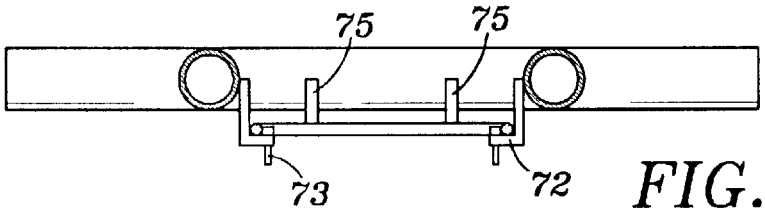
FIG. 16 is a cross sectional view taken along lines 16—16 in FIG. 15.
Figure 17:
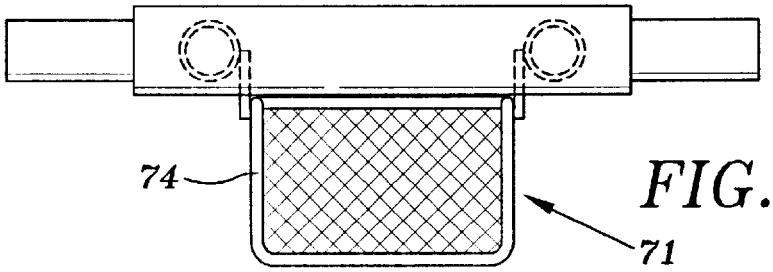
FIG. 17 is a front view of the fish basket in FIG. 15.
Figures 18, 19:
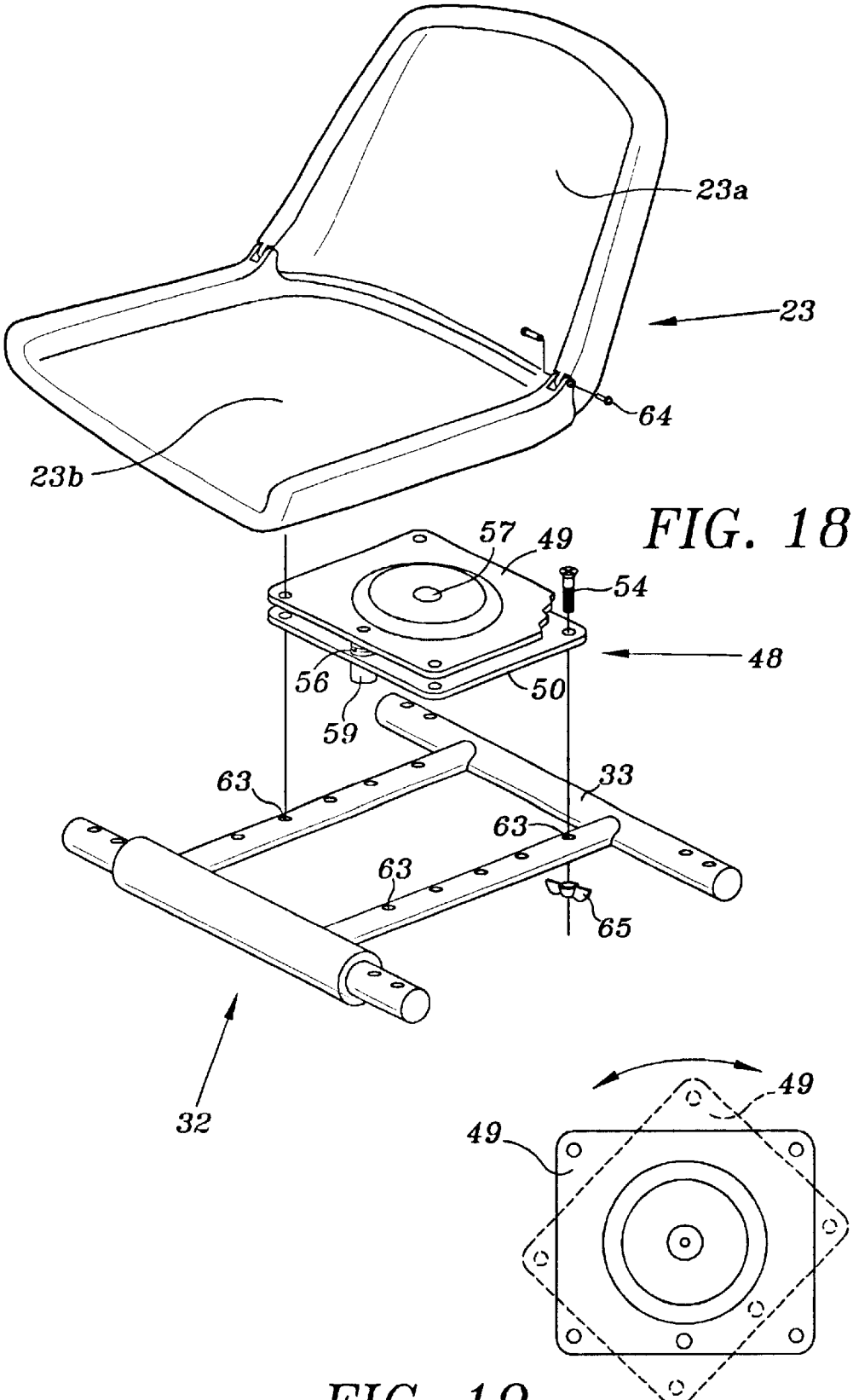
FIG. 18 is an exploded view of the seat and swivel mounting oriented with the central part of the yoke frame.
FIG. 19 is a top view illustrating the movement of the swivel mount of the seat.

Referring to FIGS. 15, 16 and 17, fish basket 71 slideably mounts beneath seat mount 32. Bracket 72 slideably mounts fish basket 71. Bracket 72 has stops 73 which engage rims 74 on fish basket 71 to prevent it from inadvertently being pulled completely out from under seat 23. Rim 74 has stops 75 which engage cross members 33 at the back of seat mount 32 to prevent fish basket 71 from sliding out of bracket 72 at the rear of seat frame 32.

Figure 13:
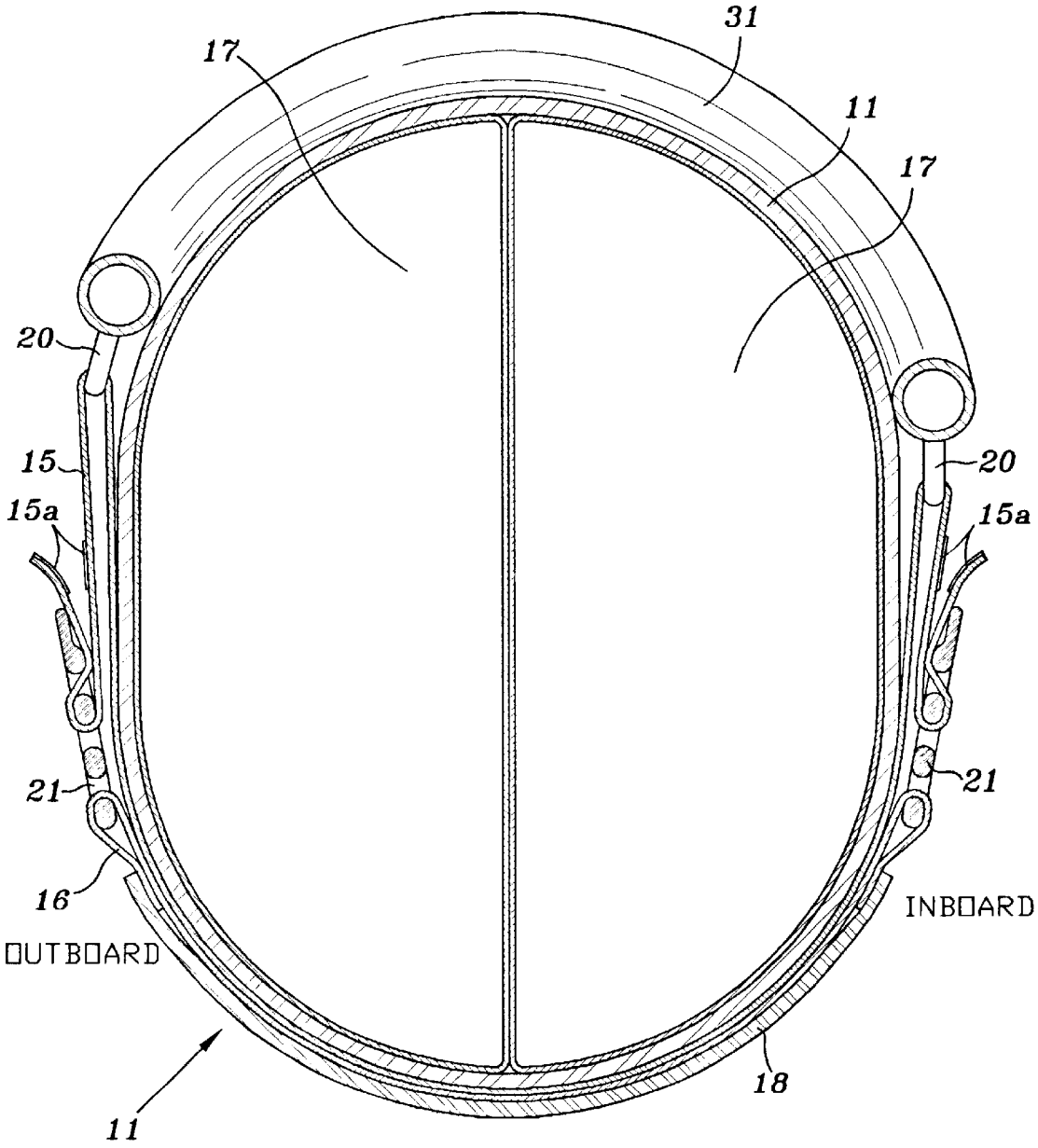
FIG. 13 is a partial sectional view taken of the pontoon along lines 13—13 in FIG. 1 illustrating the construction of the pontoon.

Referring now to FIGS. 1 and 13, each pontoon 11 has twin bladders 17 with air valves 17*a* for inflating and deflating pontoons 11. Pontoons 11 are nylon PVC coated material which is seam welded along lines 17*b*. Pontoons 11 each have nylon web strap 15 which extends beneath pontoon 11 between D-ring brackets 20 on the outboard and inboard side of pontoon 11. A short second strap 16 extends beneath pontoon 11 on top of strap 15. Strap 16 retains each buckle 21 attached approximately just above the water line of pontoon 11. Straps 15 and 16 are sewn to bottoms of pontoon 11 and a covering 18 of the same nylon PVC coated material as used for pontoon 11 is sewn thereover to provide protection for straps 15 and 16 when the watercraft 10 engages underwater objects or the bottom, as well as, moving the watercraft in and out of the water along the shoreline. Straps 15 also have Velcro fasteners to hold the ends of strap 15 against itself once the pontoons 11 have been properly secured to the yoke frame 13. The forward ends of each pontoon 11 have a convenient attachment loop 19 such that the watercraft could be hauled or otherwise towed as desired. secured to the yoke frame 13. The forward ends of each pontoon 11 have a convenient attachment loop 19 such that the watercraft could be hauled or otherwise towed as desired.

The pontoon watercraft 10 is assembled in the following manner, the main parts of yoke frame 13 are yoke members 31 and seat mount 32. The twin bladders 17 of pontoons 11 are inflated through valves 17*a* with sufficient air to fully inflate pontoons 11 which should be relatively firm. Once the pontoons 11 have been inflated the yoke frame 13 is assembled by depressing the snap button locks 43 used throughout the assembly and inserting the struts 35 in cross members 33 of seat mount 32. Prior to this assembly the seat swivel 48 is secured through aperture 93. Lower pinto 50 of goat swivel 48 is bolted in the desired position in aperture 63 of seat mount 32. Upper plate is likewise attached in any suitable manner to seat bottom 23*b*. Once yoke frame 13 is assembled, then it is placed over pontoons 11 and pontoons 11 adjusted so that the yoke members 31 seat on reinforcing strips 14 and D-rings 20 on yoke members 31 are oriented in alignment with straps 15 on either side of pontoons 11. Straps 15 are threaded through D-rings 20 then down through the bottom slot and back through the top slot in buckles 21. Straps 15 are tightened by pulling up on straps 15 which engage serrated edges of buckles 21 to hold pontoons 11 securely to yoke frame 13.

The preferred embodiment of the invention has been described and illustrated, however, it should be understood that the invention is not limited to the extent of the embodiment described and is limited only by the scope of the appended claims.

What is claimed is:

1. A pontoon watercraft comprising:

(a) two inflatable pontoons, each pontoon having a pair of spaced apart straps, each strap medially affixed to the underside of the pontoon, the straps being oriented between parallel planes through the pontoon with the axis of the pontoon perpendicular to the parallel planes;

(b) a yoke assembly including a port yoke and a starboard yoke and a central support intermediate the port yoke and starboard yoke; and (c) attaching devices for securing the yoke assembly to the two inflatable pontoons by the straps such that the straps remain between the parallel planes.

2. The watercraft of claim 1 wherein both the port and starboard yokes have inmost rails with facing struts which releasably attach to the central support for spacing the two inflatable pontoons apart.

3. The watercraft of claim 2 wherein each port and starboard yoke is adapted to adjustably receive a port foot rest and a starboard foot rest, respectively.

4. The watercraft of claim 2 wherein the port and starboard yokes adustably receive a motor and anchor mount.

5. The watercraft of claim 1 wherein the central support has two cross members for attachment to the port and starboard yokes such that the yokes remain parallel to each other, and two spaced apart support bars for retaining the cross members parallel and mounting a seat.

6. The watercraft of claim 5 wherein a seat is mounted to the support bars.

7. The watercraft of claim 6 wherein the seat is mounted on a lockable swivel mechanism attached to the support bars.

8. The watercraft of claim 1 wherein a seat is mountable in several fore and aft positions on the support bars.

9. The watercraft of claim 1 wherein the attaching devices are loop parts mounted on the port yoke and the starboard yoke, the loop parts being oriented between the parallel planes.

10. The watercraft of claim 1 wherein the pair of spaced apart straps are compound straps, each having a long strap medially affixed to the underside of the pontoon with its ends free and a short strap medially affixed over the long strap to the underside of the pontoon with a buckle attached to each end of the short strap, such that upon assembly each free end of each long strap links with the attaching devices and fastens to one of the buckles of the short strap affixed over its corresponding long strap securing the pontoons to the yoke assembly.

11. In a pontoon watercraft, a pair of elongated pontoons oriented axially parallel with each other, and a yoke assembly mounted upon the pontoons arranged to retain the pontoons in spaced apart, axially parallel arrangement to provide support for cargo, the improvement comprising:

(a) the yoke assembly for securing pontoons thereto including a pair of yoke members, one seated on the top side of each pontoon and contoured thereto, and being spaced apart by a central support attached to each yoke member;

(b) gunwales on each yoke member for mounting oars;

(c) foot rest mounting structure;

(d) a swivel mounting for attaching a seat to the central support; and (e) inflatable pontoons having strapping material sewn to the underside of each pontoon in two places, the strapping material oriented on radii with a common center on the longitudinal axis of the pontoon, the strapping material being releasably attached to the yoke assembly with the pontoons being parallel and symmetrical to each other.

12. The watercraft of claim 11 wherein the central support has two cross members for attachment to each of the pair of yokes such that the yokes remain parallel to each other, and two spaced apart support bars for retaining the two cross bars parallel.

13. The watercraft of claim 11 wherein the swivel mounting is lockable with the seat parallel to the pair of yoke members.

14. The watercraft of claim 11 wherein each of the pair of yoke members have loops for releasably attaching the pontoons with the strapping material to the pair of yoke members.

15. The watercraft of claim 11 wherein the inflatable pontoons each have compound straps having a long strap affixed to the underside of the pontoon with unaffixed end extensions and a short strap attached over the long strap to the underside of the pontoon with a buckle secured to each end of the short strap, both the long strap and the short strap being oriented bisecting the circular plane.

16. The watercraft of claim 11 wherein the two oars are provided for mounting in the gunwales, each oar having a pair of snap button locks spaced apart and oriented at 90° angles to each other to prevent inadvertent separation of the oars.

17. The watercraft of claim 11 wherein a motor and anchor mount is attached to the pair of yoke members aft of the swivel mounting for attaching the swivel seat.

18. The watercraft of claim 17 wherein a wire mesh cargo rack is positioned between the swivel seat and motor and anchor mount.

19. The watercraft of claim 17 wherein a fish basket is slideably attached beneath the seat.

20. A pontoon watercraft comprising:

(a) a pair of elongated pontoons oriented axially parallel with each other, each pontoon having a pair of spaced apart straps affixed to the underside of each pontoon, each strap oriented to exert radial forces, with ends of the straps extending substantially beyond the underside forming tie-downs;

(b) a yoke assembly including a pair of yoke members spaced apart by a central support for seating over the said pair of pontoons and spanning the top surface of the pontoons and maintaining the pontoons parallel and symmetrical with each other, held in such position with the tie-downs secured to the yoke members;

(c) a swivel seat mounted to the central support; and (d) an integrated load distribution system including adjustable foot rests, gunwales with multiple oarlocks positions and an adjustable motor mount.

* * * * *